US005613283A

United States Patent [19]

Yusfan

[11] Patent Number: 5,613,283

[45] Date of Patent: Mar. 25, 1997

[54] LACE CLOSURE SYSTEM

[76] Inventor: Shay Yusfan, 23A Tel Hay, 52335 Ramat Gan, Israel

[21] Appl. No.: 537,958

[22] Filed: Oct. 2, 1995

[51] Int. Cl.[6] ..... A43C 7/00; A43C 9/00

[52] U.S. Cl. ..... 24/713; 24/712.4; 24/16 PB; 24/116 A

[58] Field of Search ..... 24/713, 712.4, 24/712.2, 713.1, 116 A, 128, 16 PB

[56] References Cited

U.S. PATENT DOCUMENTS

| | | | |
|---|---|---|---|
| 1,669,537 | 5/1928 | Schaffer | 24/713 |
| 1,740,506 | 12/1929 | Grosser | 24/713 |
| 1,778,954 | 10/1930 | Mislin | 24/713 |
| 1,848,318 | 3/1932 | Ciampi | 24/713 |
| 2,266,083 | 12/1941 | Rzepa | 24/712.4 |
| 3,636,594 | 1/1972 | Faivre | 24/713.1 X |
| 4,071,964 | 2/1978 | Vogiatzis | 24/712.4 X |
| 5,123,913 | 6/1992 | Wilk et al. | 24/16 PB X |

*Primary Examiner*—Peter M. Cuomo
*Assistant Examiner*—Hanh V. Tran

[57] ABSTRACT

A shoelace and closure mechanism for lacing a shoe which includes a shoelace featuring a number of closure members near its ends. The outer directed portion of each of the closure members is connected to the lace while the other end is free of the shoelace. The shoe is equipped with a lace retaining member which is formed with a cutout dimensioned to allow passage an end of the shoelace when the shoelace is moved in one direction while causing one of the closure members to open and engage the cutout and thereby immobilize the shoelace when an attempt is made to move the shoelace in the opposite direction.

19 Claims, 4 Drawing Sheets

LACE CLOSURE SYSTEM

FIELD AND BACKGROUND OF THE INVENTION

The present invention relates to shoelaces and mechanisms for facilitating their closure, and, more generally, to various linear tying elements and mechanisms for their closure.

For purposes of description, the description herein is focused on shoelaces, it being understood that the present invention is not limited in scope only to shoelaces and can beneficially be used in various other context, including, but not limited to, the tightening of sandals, belts, packages, cases, and various loads.

Shoelaces have been in widespread use for hundreds of years to secure a shoe to the foot of a user. The conventional shoelace is a smooth linear member made of cloth, leather or plastic. The shoelace is wound through a series of holes arranged in the upper portion of the shoe so as to straddle the opening in the shoe through which the user's foot is inserted into or retracted from the shoe. To use the shoelace the foot is first inserted into the shoe. Then, the two ends of the shoelace are pulled so as to bring the openings in the shoe upper together, thereby tightening the shoe around the foot. The two ends of the shoelace are then tied together so as to prevent the inadvertent loosening of the shoe.

Conventional shoelace arrangements suffer from a number of disadvantages which revolve primarily about the need to tie the two ends of the shoelace together. First, the process of tying the ends together is relatively time consuming and requires a certain amount of skill and manual dexterity which is not always available. For example, anyone watching a young child struggle with his or her shoelaces would appreciate the complexity of the task. Similarly, many elderly and incapacitated persons with impaired vision and/or impaired manual abilities, find it difficult or impossible to negotiate the intricate maneuvering involved in tying a shoelace.

Another disadvantage of tying a shoelace together in the conventional manner is that in the act of tying the shoelace the shoelace is able to withdraw somewhat from the hands of the user which results in the sometime considerable loosening of the fit of the shoe about the user's foot. In addition, there is a tendency for the knot to loosen and, in some cases, to become completely undone, requiring the retying of the laces.

Various solutions have been proposed. Perhaps the most successful to date has been the use of quick-fastening mechanisms, such as Velcro. While these mechanisms greatly facilitate the tightening of the shoe, these mechanisms suffer from the disadvantage that the connection is made in only one or two locations along the shoe upper. This is in contrast with the continuous and uninterrupted connection over a large portion of the shoe upper which is provided by conventional shoelace connection. The Velcro-type mechanisms suffer from the further disadvantage that the undoing of such a connection is usually accompanied by a distinct noise which some people find rather annoying.

There is thus a widely recognized need for, and it would be highly advantageous to have, a shoelace and related shoelace shoe mechanism which will provide the continuous tightening of conventional shoelaces but which will facilitate the rapid and easy tying, using a single continuous motion, of the shoelaces without the loosening which attends the tying of conventional shoelaces.

SUMMARY OF THE INVENTION

According to the present invention there is provided a lace system for lacing an object, comprising: (a) a lace having a pair of ends; (b) a plurality of closure members connected to, or integrally formed with, the lace near each of the pair of ends of the lace, each of the closure members having an outer-directed portion and an inner-directed portion, the outer-directed portions of each of the closure members being connected to, or integrally formed with, the lace while the inner-directed portion of each of the closure members is free of the lace; and (c) a lace retaining member connected to, or integrally formed with, the object, the lace retaining member formed with a cutout dimensioned to allow passage through the cutout of one of the ends of the lace along with the closure members when the lace is moved in a first direction while causing one of the closure members to engage the cutout and thereby immobilize the lace when an attempt is made to move the lace in a second direction which is opposed to the first direction.

The present invention successfully addresses the shortcomings of the presently known configurations by providing a lace system which facilitates the ready and effective tightening and loosening of a shoe, or similar object.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a lace closure system which can be used to quickly and effectively secure the tightening of a shoe or any other object, or objects, which can be tightened with the use of laces and the like.

The principles and operation of a system according to the present invention may be better understood with reference to the drawings and the accompanying description which relate specifically to shoelaces.

It should be pointed out at the outset that while for ease of presentation, reference is made throughout the description to the use of the present invention in the context of shoes, i.e., as a shoelace system, it will readily be appreciated that a system such as that described and claimed herein can also be used in other applications such as for sandals, belts, cases, packages and in the tying down of various load, and the like. It is thus intended that the present invention not be limited in scope to shoelace systems but should instead include various related systems wherein a lace, rope, cable, and the like (hereinafter referred to singly and collectively as "lace") is used to tighten an object or connect a pair of objects.

Figure 1:
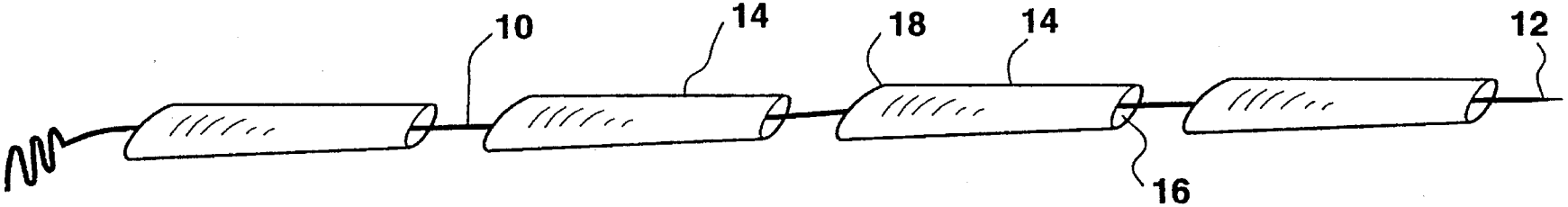
FIG. 1 is a side view of a shoelace according to the present invention.
Figure 2:
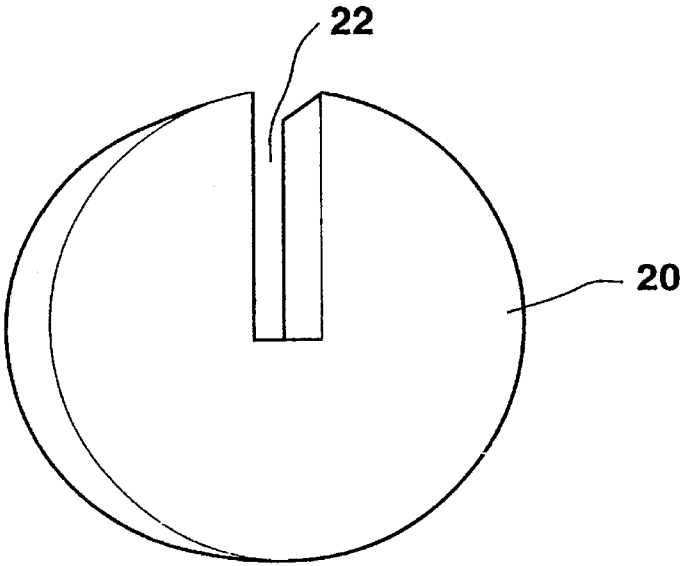
FIG. 2 is a shoelace retaining member according to the present invention.
Figure 3:
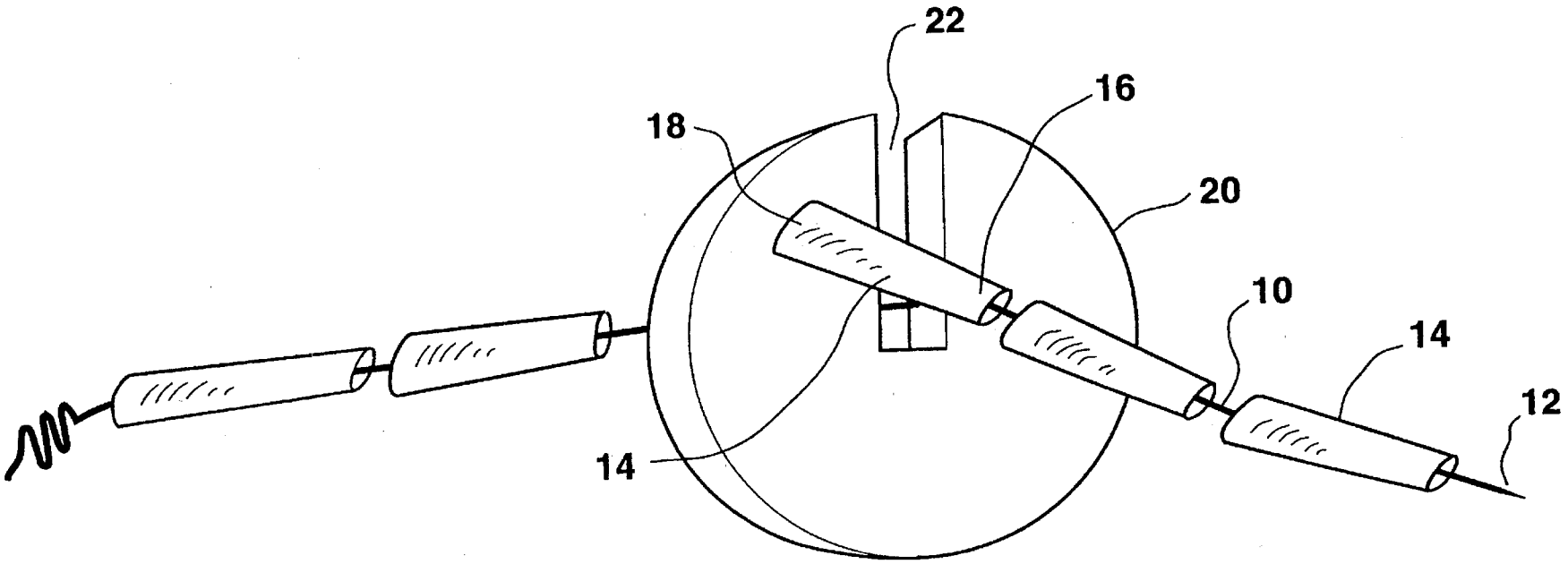
FIG. 3 shows the shoelace of FIG. 1 and shoelace retaining member of FIG. 2 as they might appear in operation.

Referring now to the drawings, FIGS. 1–3 illustrate the main components of a system according to the present invention. Shown in FIG. 1 is a portion of a possible shoelace 10 according to the present invention. The portion depicted is the portion of the shoelace near one of its ends 12. The portion of shoelace 10 near the other end would be formed in the same way.

Shoelace 10 can be made of any suitable material, including, but not limited to, cloth, plastic, leather and the like. Shoelace 10 can be of any suitable length and cross sectional shape and area.

The end portion of shoelace 10 is characterized in that it includes a number of closure members 14 which are connected to, or which are integrally formed with, shoelace 10. Each of closure members 14 has a outer-directed portion 16 and an inner-directed portion 18, outer-directed portion 16 being the portion of closure member 14 which is closer to the nearest end 12 of shoelace 10 while inner-directed portion 18 is the portion of closure member 14 which is closer to the center of shoelace 10, i.e., farthest from the near end 12 of shoelace 10.

Outer-directed portions 16 of each of closure members 14 is connected to, or is integrally formed with, lace 10 while inner-directed portions 18 of closure members 14 is free of lace 10. In applications not involving shoelaces it may be desirable so have closure members only on one end of the lace, rather than at both ends so that, for example, the end of the lace not featuring closure members is permanently or otherwise attached to an object to be tightened or to an object to be connected to a second object.

Figure 4:
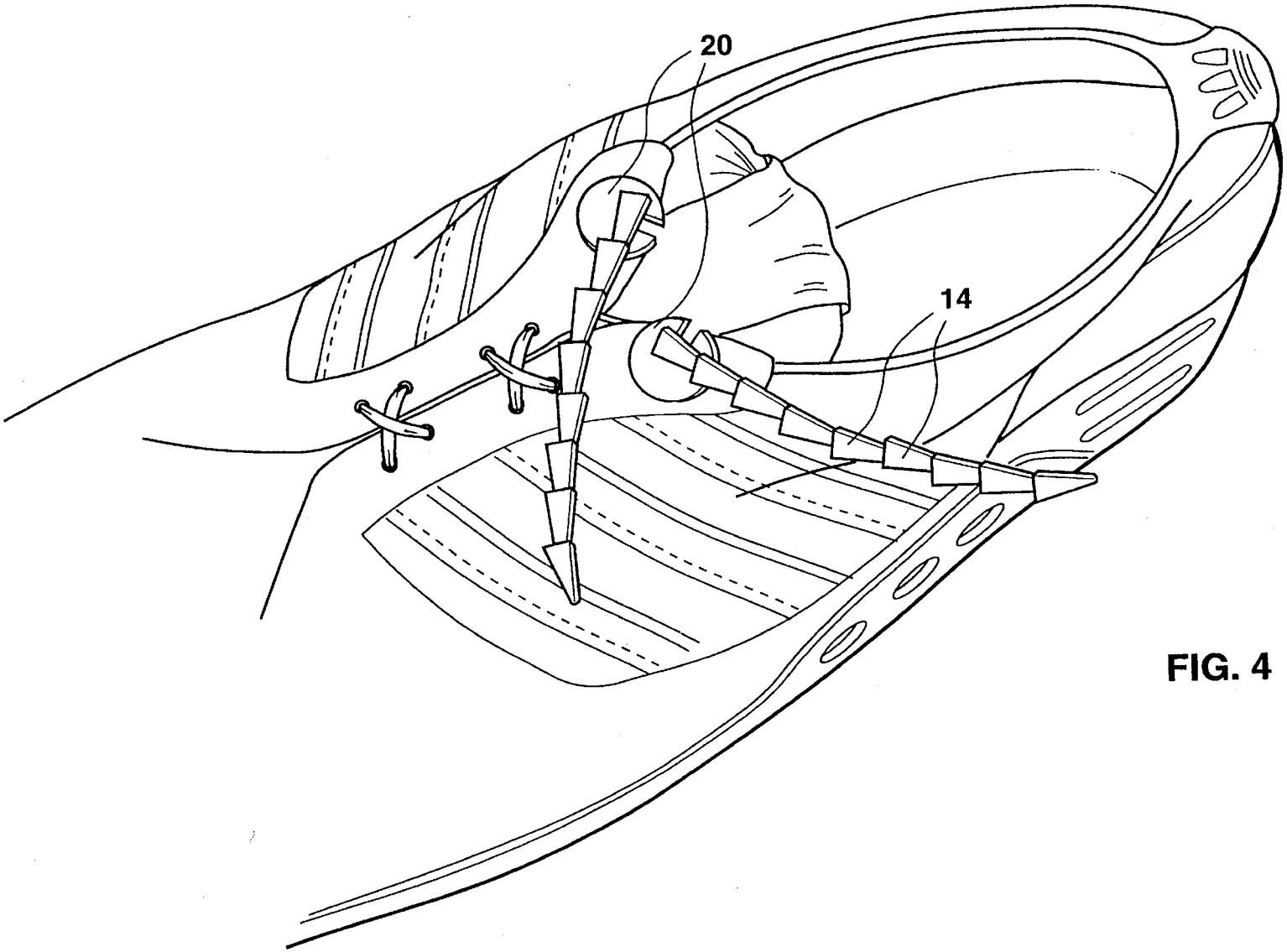
FIG. 4 shows a portion of a shoe with a shoelace and shoelace retaining member according to the present invention.
Figure 5:
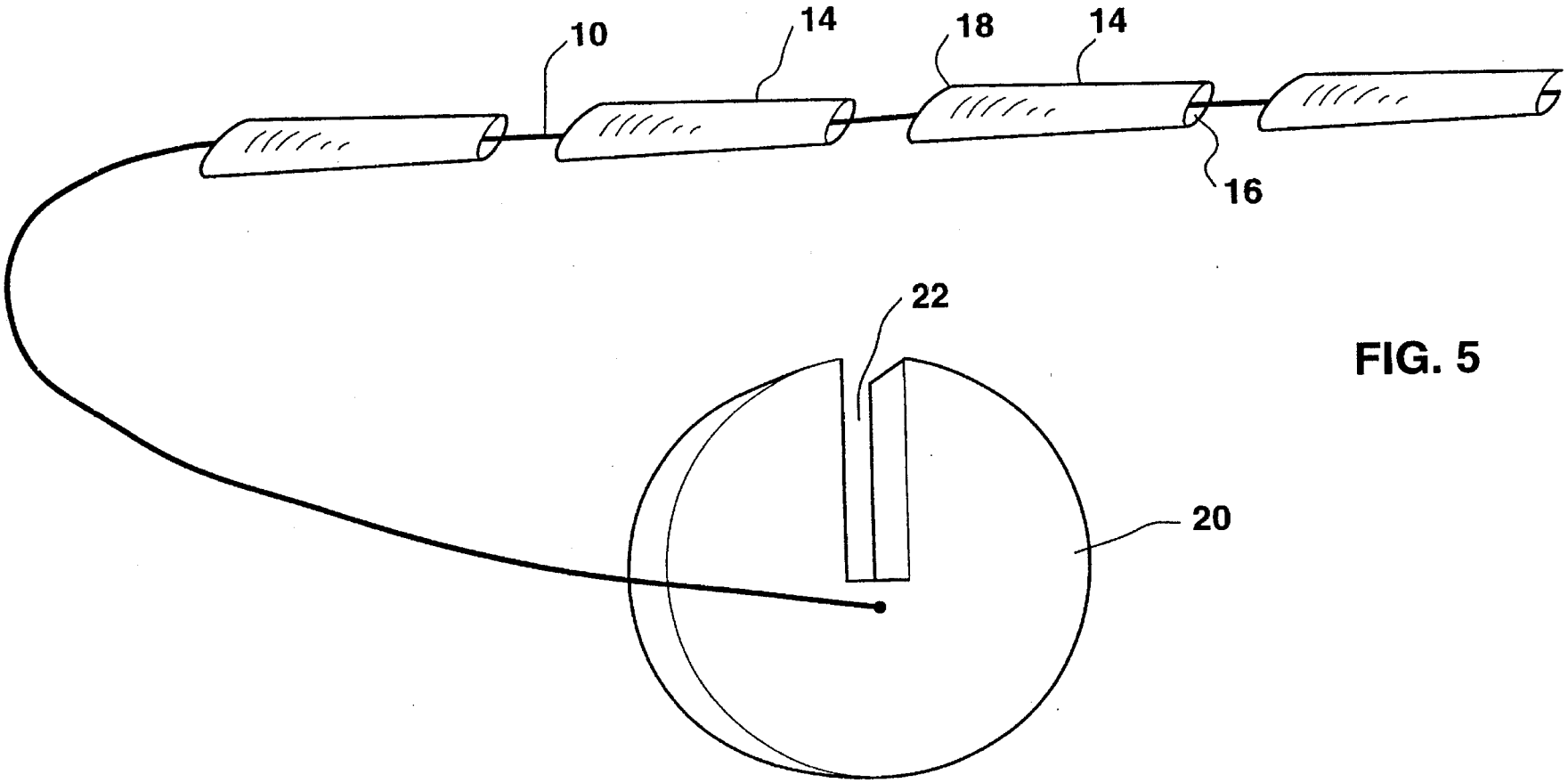
FIG. 5 shows a lace according to another embodiment of the present invention.

A mechanism according to the present invention further features a shoelace retaining member 20 which is connected to, or which is integrally formed with, the shoe (FIG. 4). The connection may be effected in any suitable manner. Retaining member 20 may be of any suitable shape and may be made of a variety of suitable materials, preferably rigid or semi-rigid. In applications not involving shoe laces, the retaining member is connected to an object to be tightened or to an object which is to be connected to a second object.

Retaining member 20 is formed with a cutout 22, preferably in the form of a slit, which is dimensioned to allow passage of one of shoelace 10, along with closure members 14, when lace 10 is moved in one direction (to the right in FIGS. 1 and 3) while causing one of closure members 14 to engage retaining member 20 when an attempt is made to move shoelace 10 in the opposite direction (to the left in FIGS. 1 and 3), thereby serving to immobilize shoelace 10 and prevent the loosening of the shoe.

The operation of the lace mechanism according to the present invention may best be understood with reference to FIG. 3. As can be seen, in the absence of contrary forces, closure members 14 lie substantially parallel and close to shoelace 10. However, when a force is exerted on the inner-directed portion 18 of closure member 14, inner-directed portion 18 has the ability to move away from shoelace 10, thereby presenting a profile which is too large to pass through cutout 22.

To use a mechanism according to the present invention one would first lace a pair of shoes using a shoelace according to the present invention equipped with a series of closure members near the ends of the shoelace. The relatively low profile of the closure members when they are adjacent the shoelace permits the laces to freely go through the conventional shoelace holes in the upper of the shoe.

To immobilize the shoelace at a certain tightness about the foot the ends of the laces are first pulled to achieve the desired tightness. Then, each end is inserted into the corresponding cutout of the retaining member (FIG. 4) and the shoelace is released. There is a force which exerted by the shoe upper on both ends of the shoelace tending to loosen the fit of the shoe. This force causes a small movement of the ends of the shoelace through the retaining member. However, this movement is rapidly stopped as the inner-directed portion of one of the closure members touches the retaining member and is caused to pivot about the outer-directed portion away from the shoelace. In this position (FIG. 3) the shoelace is immobilized and cannot move further.

The shoe is now 'tied' and the user can proceed with normal activities. To loosen the shoe, as prior its removal, all the user need do is slide the shoelace laterally through the cutout so as to remove the shoelace from the retaining member.

To use a device according to the present invention in applications not involving shoelaces, for example, to fasten a belt, one end of the lace may be permanently attached to one end of the belt while the retaining member is connected to the other end of the belt. To tighten the belt the two ends of the belt are pulled toward each other and the lace is inserted into the cutout of the retaining member so that the closure members engage the retaining member.

While the invention has been described with respect to a limited number of embodiments, it will be appreciated that many variations, modifications and other applications of the invention may be made.

What is claimed is:

1. A lace system, comprising:

(a) an object;

(b) a lace having a pair of ends;

(c) at least two closure members on said lace near each of the said pair of ends of said lace, each of said closure members having an outer-directed portion and an inner-directed portion, said outer directed portions of each of said closure members being on said lace while said inner-directed portion of each of said closure members is free of said lace; and (d) a lace retaining member fixed to said object, said lace retaining member formed with a cutout dimensioned to allow passage through said cutout of one of said ends of said lace along with said closure members when said lace is moved in a first direction while causing said inner-directed portion of one of said closure members to pivot about said outer-directed portion of said closure member and engage said lace retaining member, thereby immobilizing said lace when an attempt is made to move said lace in a second direction which is opposed to said first direction.

2. The system of claim 1, wherein said lace is a shoelace and the object is a shoe.

3. The system of claim, 1, wherein said closure members are connected to said laces.

4. The system of claim 1, wherein said closure members are integrally formed with said laces.

5. The system of claim 1, wherein said cutout is in the form of a slit.

6. The system of claim 1, wherein said lace retaining member is connected to said object.

7. The system of claim 1, wherein said lace retaining member is integrally formed with said object.

8. A lace system comprising:

(a) at least one object;

(b) a lace having a pair of ends;

(c) at least two closure members on said lace near at least one of said pair of ends of said lace, each of said closure members having an outer-directed portion and an inner-directed portion, said outer-directed portions of each of said closure members being on said lace while said inner-directed portion of each of said closure members is free of said lace; and (d) a lace retaining member fixed to said at least one object, said lace retaining member formed with a cutout dimensioned to allow passage through said closure of one of said ends of said lace along with said closure members when said lace is moved in a first direction while causing said inner-directed portion of one of said closure members to pivot about said outer-directed portion of said closure member and engage said lace retaining member, thereby immobilizing said lace when an attempt is made to move said lace in a second direction which is opposed to said first direction.

9. The system of claim 8, wherein said closure members are connected to said laces.

10. The system of claim 8, wherein said closure members are integrally formed with said laces.

11. The system of claim 8, wherein said cutout is in the form of a slit.

12. The system of claim 8, wherein said lace retaining member is connected to said object.

13. The system of claim 8, wherein said lace retaining member is integrally formed with said object.

14. A lace system comprising:

(a) a lace having a pair of ends;

(b) at least two closure members on said lace near one of said pair of ends of said lace, each of said closure members having an outer-directed portion and an inner-directed portion, said outer-directed portions of each of said closure members being on said lace while said inner-directed portion of each of said closure members is free of said lace; and (c) a lace retaining member fixed to the other end of said lace said lace retaining member formed with a cutout dimensioned to allow passage through said cutout of one of said ends of said lace along with said closure members when said lace is moved in a first direction while causing said inner-directed portion of one of said closure members to pivot about said outer-directed portion of said closure member and engage said lace retaining member, thereby immobilizing said lace when an attempt is made to move said lace in a second direction which is opposed to said first direction.

15. The system of claim 14, wherein said lace retaining member is connected to said end of said lace.

16. The system of claim 14, wherein said lace retaining member is integrally formed with said end of said lace.

17. The system of claim 14, wherein said closure members are connected to said end of said lace.

18. The system of claim 14, wherein said closure members is integrally formed with said end of said lace.

19. The system of claim 14, wherein said cutout is in the form of a slit.

* * * * *